US005583477A

United States Patent [19]

Yen

[11] Patent Number: 5,583,477

[45] Date of Patent: Dec. 10, 1996

[54] WIRELESS AC/DC BELL

[75] Inventor: Chason Yen, Taipei, Taiwan

[73] Assignee: Mosten Products Company, Taipei, Taiwan

[21] Appl. No.: 613,140

[22] Filed: Mar. 8, 1996

[51] Int. Cl.[6] ..... G08B 3/00

[52] U.S. Cl. ..... 340/328; 340/384.7; 340/392.1; 340/825.52; 340/825.72; 116/148; 341/176

[58] Field of Search ..... 340/326, 328, 340/392.1, 384.1, 384.7, 825.69, 825.72, 825.31, 825.52, 539; 116/148; 455/66; 341/176

[56] References Cited

U.S. PATENT DOCUMENTS 4,731,603 3/1988 McRae et al. ..... 340/825.46
5,291,193 3/1994 Isobe et al. ..... 341/176
5,365,214 11/1994 Angott et al. ..... 340/384.5
5,475,369 12/1995 Baker ..... 340/328

*Primary Examiner*—Jeffery Hofsass
*Assistant Examiner*—Daniel J. Wu
*Attorney, Agent, or Firm*—Beveridge, DeGrandi, Weilacher & Young, LLP

[57] ABSTRACT

A wireless AC/DC bell which includes a transmitter circuit, which includes a battery power source, an indicator light, a modulation transistor, and an amplifier, and a receiver circuit, which includes a receiving antenna, a demodulator, an amplifier-rectifier circuit, a modulation transistor, a frequency discriminator, a register, and a speaker starter, wherein the transmitter circuit is driven by a bell button to produce a radio ringing signal; the speaker driver of the receiver circuit is driven to drive a speaker when the receiving antenna receives the radio ringing signal from the transmitter circuit and the received radio ringing signal is processed through the demodulator, the amplifier-rectifier circuit, the modulation transistor, the frequency discriminator, and the register.

1 Claim, 2 Drawing Sheets

WIRELESS AC/DC BELL

BACKGROUND OF THE INVENTION

The present invention relates to electric bells, and relates more particularly to a wireless AC/DC bell.

An electric bell either consuming AC power supply or DC power supply, is generally comprised of a bell, a bell button, and an electric wire connected between the bell and the bell button. This structure of electric bell is difficult to install. During the installation, special tools and fastening devices may be used so that the electric wire can be fastened to the desired location. When to insert the electric wire through the wall or any part of the house, a wire hole may have to be made, and the formation of the wire hole may destroy the integrity of the structure of the house. Furthermore, regular electric bells are designed for use AC power supply or DC power supply only. Few electric bells are designed to alternatively consume AC power supply and DC power supply.

SUMMARY OF THE INVENTION

It is one object of the present invention to provide an electric bell which can be conveniently installed by the user without the connection of an electric wire between the bell and the bell button. It is another object of the present invention to provide a wireless electric bell which can be alternatively used with AC power supply and DC power supply.

According to the preferred embodiment of the present invention, the wireless AC/DC bell comprises a transmitter circuit and a receiver circuit. The transmitter circuit comprises a battery power source, an indicator light, a modulation transistor, an amplifier, and a bell button, wherein the indicator light is turned on and the modulation transistor of the transmitter circuit is driven to provide a ringing signal when the bell button is depressed; the amplifier is to amplify the ringing signal from the modulation transistor of the transmitter circuit and then to drive the amplified signal out of the transmitter circuit; the modulation transistor of the transmitter circuit is connected to two bridging multiple switch connectors which have sets of bridging contacts alternatively selected to provide a radio signal of a particular oscillating frequency for output. The receiver circuit comprises a receiving antenna which receives the output radio signal of the transmitter circuit, a demodulator which demodulates the radio signal received by the receiving antenna, an amplifier-rectifier circuit and a modulation transistor which amplify the demodulated signal from the demodulator and rectify it into a square wave signal, a discriminator which decodes the square wave signal from the amplifier-rectifier circuit into a digital signal, a register which receives the digital digital signal from the discriminator and then provides an output signal, a speaker, a speaker starter driven by the output signal of the register to turn on the speaker, and an AC/DC power supply circuit which provides the necessary working voltage to the receiver circuit; the modulation transistor of the receiver circuit is connected to a bridging multiple switch connector for the selection of an oscillating frequency corresponding to the oscillating frequency selected through the bridging multiple switch connectors of the modulation transistor of the transmitter circuit.

DETAILED DESCRIPTION OF THE PREFERRED EMBODIMENT

Figure 1:
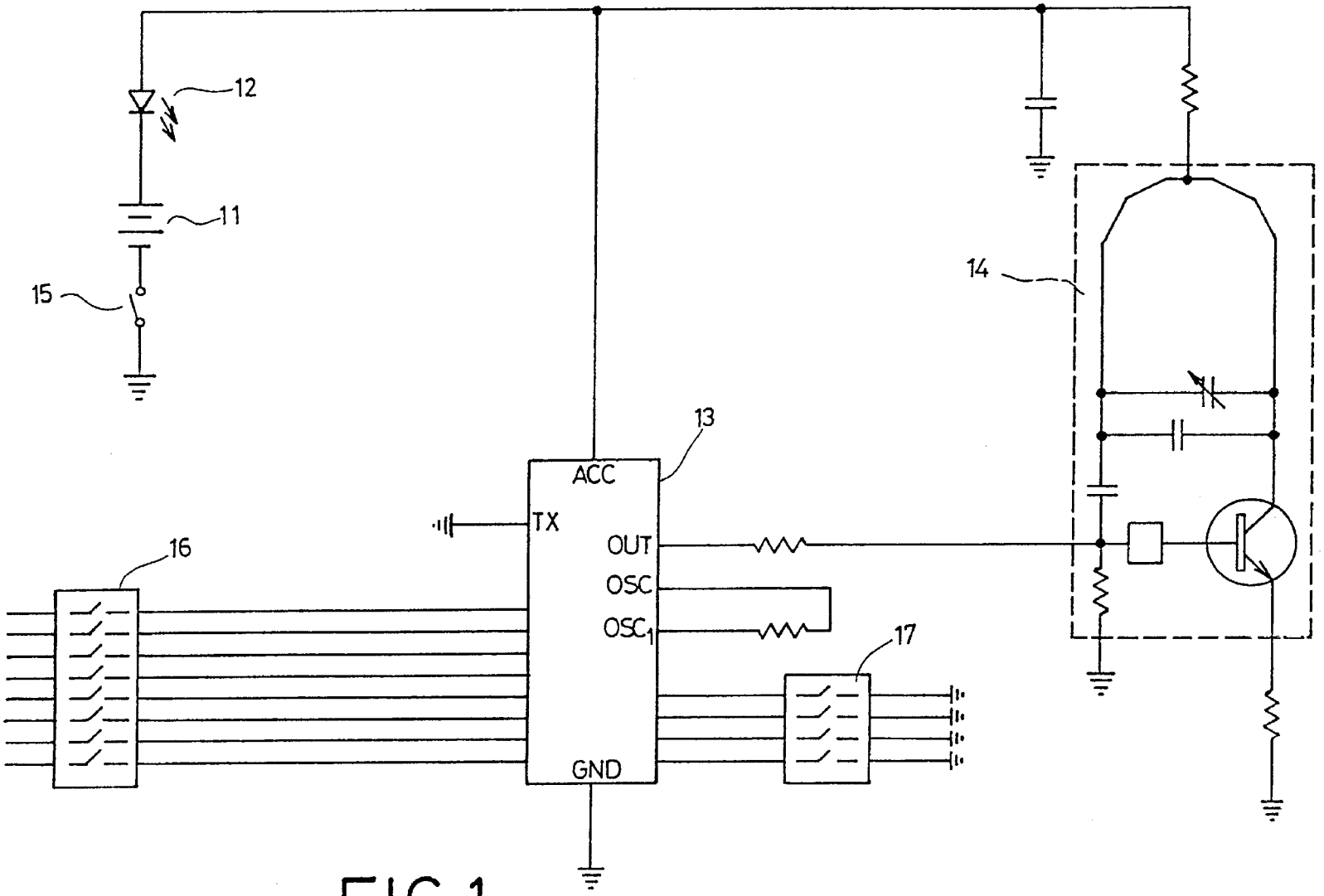
FIG. 1 is a transmitter circuit according to the present invention.
Figure 2:
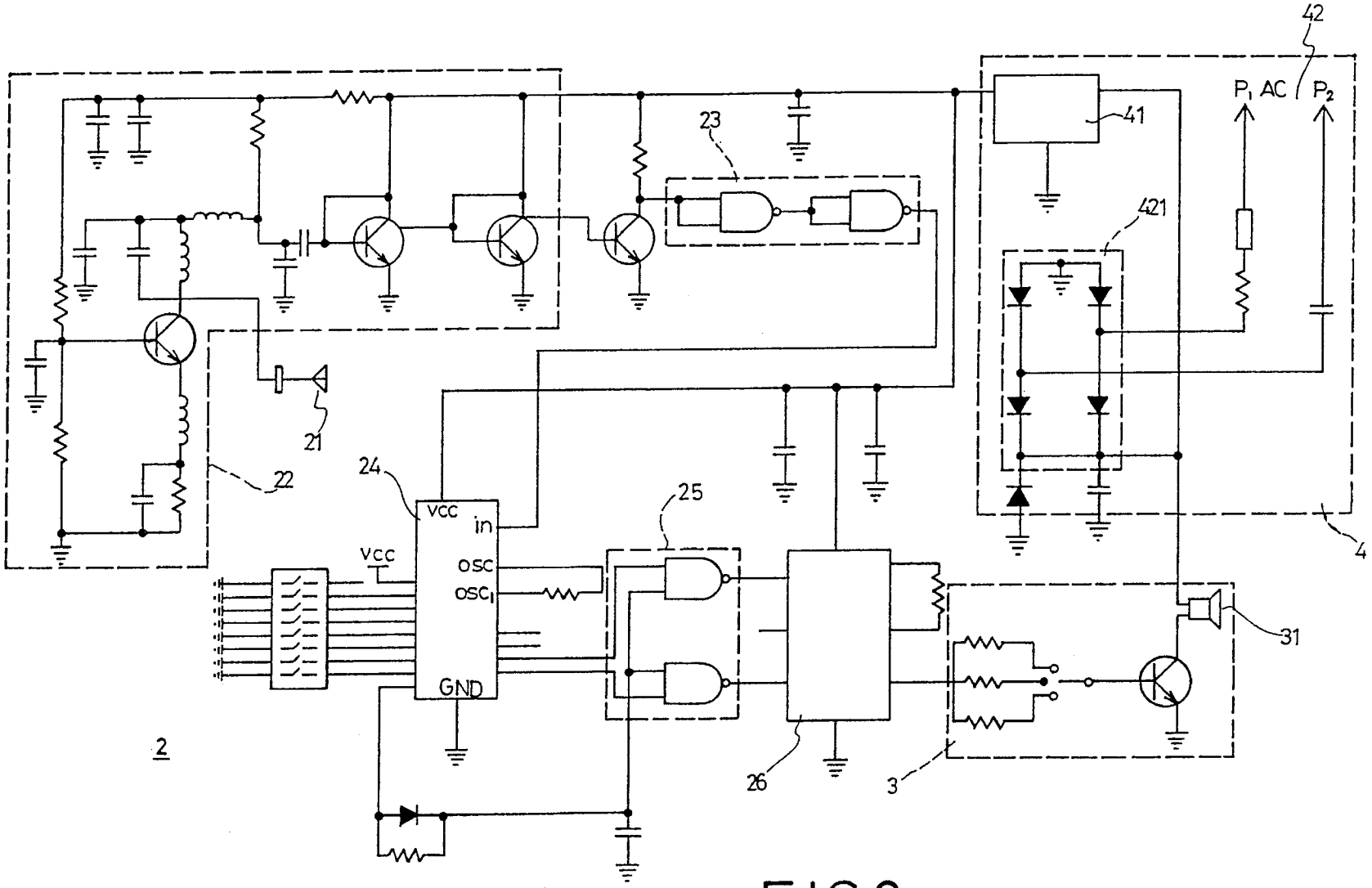
FIG. 2 is a receiver circuit according to the present invention.

Referring to FIGS. 1 and 2, a wireless AC/DC bell in accordance with the present invention is generally comprised of a transmitter circuit 1, and a receiver circuit 2.

The transmitter circuit 1 comprises a battery power source 11, an indicator light 12, a modulation transistor 13, an amplifier 14, and a bell button 15. When the bell button 15 is depressed, the indicator light 12 is turned on, and at the same time the battery power source 11 is electrically connected to the modulation transistor 13, causing it to produce a ringing signal. The ringing signal from the modulation transistor 13 is then amplified by the amplifier 14, and then sent out of the transmitter circuit 1. The modulation transistor 13 is connected to two bridging multiple switch connectors 16, 17 which have sets of bridging contacts alternatively selected to provide a radio signal of a particular oscillating frequency for output.

The receiver circuit 2 comprises a receiving antenna 21, a demodulator 22, an amplifier-rectifier circuit 23, a modulation transistor 24, a frequency discriminator 25, a register 26, a speaker starter 3, and an AC/DC power supply circuit 4. The AC/DC power supply circuit 4 comprises a DC power source 41, and an AC power source 42 connected in parallel to the DC power source 41. The AC power source 42 includes a rectifier 421. When a radio signal is received by the receiving antenna 21, it is immediately demodulated by the demodulator 22, then amplified and processed into a square wave signal by the amplifier-rectifier circuit 23 and the modulation transistor 24, and then decoded into a digital signal by the discriminator 25, and then stored in the register 26. When the register 26 receives the output digital signal from the discriminator 25, it provides a signal to the speaker starter 3, causing it to drive a speaker 31. The modulation transistor 24 is connected to a bridging multiple switch connector 27 for the selection of an oscillating frequency corresponding to the oscillating frequency selected through the bridging multiple switch connectors 16, 17.

As indicated, the speaker 31 of the speaker starter 3 of the receiver circuit 2 is driven by a particular radio signal transmitted from the transmitter circuit 1. Because no signal line is needed between the bell button and the bell, the wireless AC/DC bell can be conveniently installed in any place by the user. Furthermore, because of the installation of the AC/DC power supply circuit, AC and DC power supply can be alternatively used.

While only one embodiment of the present invention has been shown and described, it will be understood that various modifications and changes could be made without departing from the spirit and scope of the invention disclosed.

What the invention claimed is:

1. A wireless AC/DC bell comprising:

a transmitter circuit, said transmitter circuit comprising a battery power source, an indicator light, a modulation transistor, an amplifier, and a bell button, said indicator light being turned on and the modulation transistor of said transmitter circuit being driven to provide a ringing signal when said bell button is depressed, said amplifier being to amplify the ringing signal from the modulation transistor of said transmitter circuit and then to drive the amplified signal out of said transmitter circuit, the modulation transistor of said transmitter circuit being connected to two bridging multiple switch connectors which have sets of bridging contacts alternatively selected to provide a radio signal of a particular oscillating frequency for output; and a receiver circuit to receive the output radio signal of said transmitter circuit, said receiver circuit comprising a receiving antenna which receives the output radio signal of said transmitter circuit, a demodulator which demodulates the radio signal received by said receiving antenna, an amplifier-rectifier circuit and a modulation transistor which amplify the demodulated signal from said demodulator and rectify it into a square wave signal, a discriminator which decodes the square wave signal from said amplifier-rectifier circuit into a digital signal, a register which receives the digital digital signal from said discriminator and then provides an output signal, a speaker, a speaker starter driven by the output signal of said register to turn on said speaker, and an AC/DC power supply circuit which provides the necessary working voltage to said receiver circuit, the modulation transistor of said receiver circuit being connected to a bridging multiple switch connector for the selection of an oscillating frequency corresponding to the oscillating frequency selected through the bridging multiple switch connectors of the modulation transistor of said transmitter circuit.

* * * * *